US011640124B2

(12) United States Patent
Matsumoto et al.

(10) Patent No.: US 11,640,124 B2
(45) Date of Patent: May 2, 2023

(54) DEVELOPING DEVICE AND IMAGE FORMING APPARATUS INCORPORATING SAME

(71) Applicants: Kentarou Matsumoto, Tokyo (JP); Yuki Oshikawa, Kanagawa (JP)

(72) Inventors: Kentarou Matsumoto, Tokyo (JP); Yuki Oshikawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/460,323

(22) Filed: Aug. 30, 2021

(65) Prior Publication Data

US 2022/0082956 A1 Mar. 17, 2022

(30) Foreign Application Priority Data

Sep. 11, 2020 (JP) ..... JP2020-152727

(51) Int. Cl.
*G03G 15/08* (2006.01)
*G03G 15/30* (2006.01)
*G03G 15/16* (2006.01)

(52) U.S. Cl.
CPC ..... *G03G 15/0806* (2013.01); *G03G 15/1615* (2013.01); *G03G 15/307* (2013.01)

(58) Field of Classification Search
CPC ..... G03G 15/806; G03G 15/1615
See application file for complete search history.

(56) References Cited

U.S. PATENT DOCUMENTS

2001/0024581 A1* 9/2001 Miyabe ..... G03G 21/1676 399/119

FOREIGN PATENT DOCUMENTS

| | | |
|---|---|---|
| JP | 2003-156985 | 5/2003 |
| JP | 2008-276151 | 10/2006 |
| JP | 2009-223075 | 10/2009 |
| JP | 2010-224017 | 10/2010 |
| JP | 2012-078724 | 4/2012 |

* cited by examiner

*Primary Examiner* — Roy Y Yi
*Assistant Examiner* — Andrew V Do
(74) *Attorney, Agent, or Firm* — Xsensus LLP

(57) ABSTRACT

A developing device includes a developing roller, a developing case, and a support. The developing roller includes a sleeve and a magnetic field generator. The sleeve is rotatable and includes a hollow shaft at an axial end of the sleeve. The magnetic field generator is irrotationally disposed inside the sleeve and includes a non-rotating shaft at an axial end of the magnetic field generator. The non-rotating shaft penetrates through the hollow shaft and projects outward. The developing case is configured to store developer and rotatably supports the hollow shaft. The support includes a fitting portion into which the non-rotating shaft of the magnetic field generator is irrotationally fitted. The support is supported on the developing case using the fitting portion as a main-positioning portion.

17 Claims, 8 Drawing Sheets

DEVELOPING DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2020-152727, filed on Sep. 11, 2020 in the Japan Patent Office, the entire disclosure of each of which is hereby incorporated by reference herein.

BACKGROUND

Technical Field

This disclosure generally relates to a developing device to develop a latent image formed on a surface of an image bearer such as a photoconductor drum, and an image forming apparatus including the developing device, such as a copier, a printer, a facsimile machine, or a multifunction peripheral (MFP) having at least two of such functions.

Related Art

As a developing device included in an image forming apparatus such as a copier and a printer, a developing device employing a two-component developing method is widely used that includes a developing roller in which a magnetic field generator such as a magnet is disposed.

SUMMARY

This specification describes an improved developing device that includes a developing roller, a developing case, and a support. The developing roller includes a sleeve and a magnetic field generator. The sleeve is rotatable and includes a hollow shaft at an axial end of the sleeve. The magnetic field generator is irrotationally disposed inside the sleeve and includes a non-rotating shaft at an axial end of the magnetic field generator. The non-rotating shaft penetrates through the hollow shaft and projects outward. The developing case is configured to store developer and rotatably supports the hollow shaft. The support includes a fitting portion into which the non-rotating shaft of the magnetic field generator is irrotationally fitted. The support is supported on the developing case using the fitting portion as a main-positioning portion.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
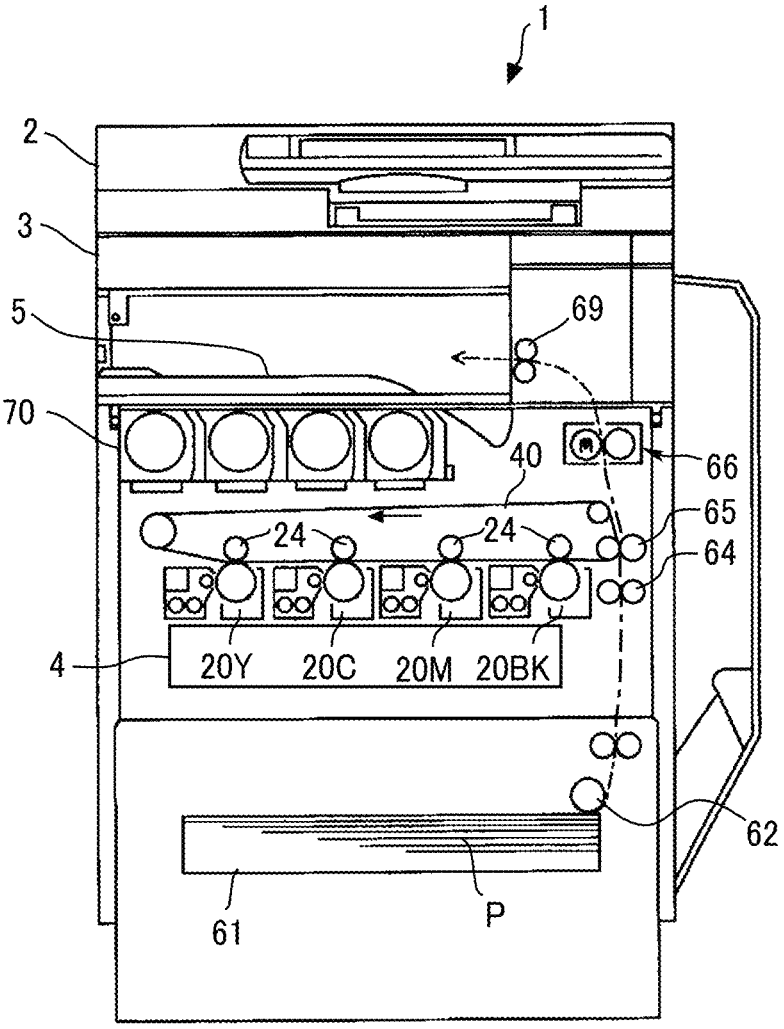
FIG. 1 is a schematic view of a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise. Identical reference numerals are assigned to identical components or equivalents and a description of those components is simplified or omitted.

Initially with reference to FIG. 1, a configuration and operation of an image forming apparatus 1 according to an embodiment of the present disclosure is described below.

Figure 2:
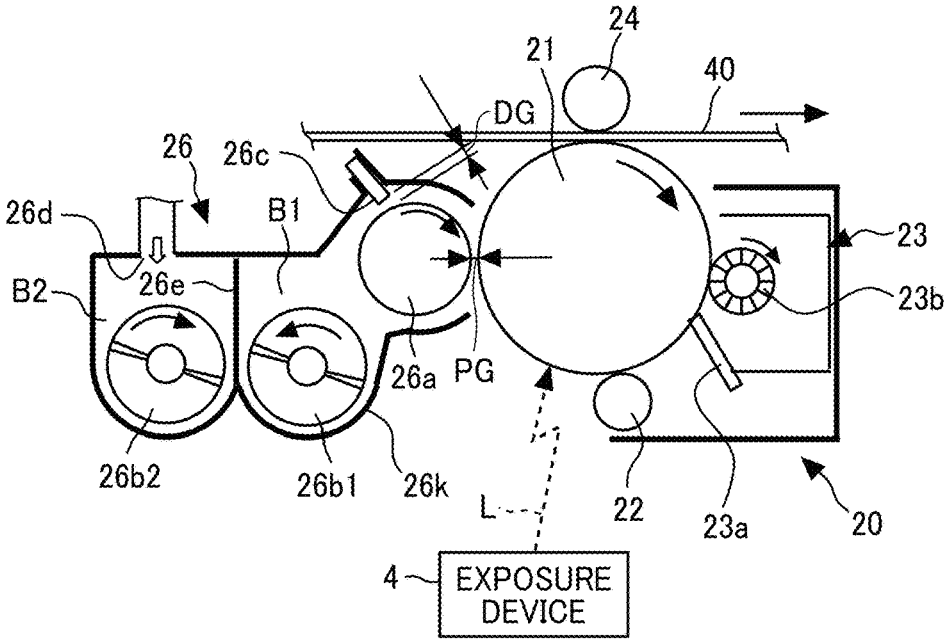
FIG. 2 is a cross-sectional view of an image forming unit of the image forming apparatus of FIG. 1.

The image forming apparatus 1 according to the present embodiment is a tandem multicolor image forming apparatus in which process cartridges 20Y, 20M, 20C, and 20BK are arranged in parallel to each other, facing an intermediate transfer belt 40. In each of the process cartridges 20Y, 20M, 20C, and 20BK, a developing device 26 is disposed to face a photoconductor drum 21 as illustrated in FIG. 2.

In FIG. 1, the image forming apparatus 1, which is a color copier in the present embodiment, includes a document conveyance device 2, a scanner 3 as a document reading device, and an exposure device 4 as a writing device. The document conveyance device 2 conveys a document to the scanner 3. The scanner 3 reads image data of the document.

The exposure device 4 emits a laser beam based on input image data.

In addition, the image forming apparatus 1 includes the process cartridges 20Y, 20M, 20C, and 20BK to form yellow, magenta, cyan and black toner images on respective surfaces of the photoconductor drums, respectively, and an intermediate transfer belt 40 on which the yellow, magenta, cyan and black toner images are transferred and superimposed.

The image forming apparatus 1 further includes a sheet feeder 61 to accommodate sheets P such as paper sheets, a secondary transfer roller 65 to transfer the toner image formed on the intermediate transfer belt 40 onto the sheet P, a fixing device 66 to fix the unfixed toner image on the sheet P, and toner containers 70 to supply toners of respective colors to the developing devices 26 of the corresponding process cartridges 20Y, 20M, 20C, and 20BK.

Each of the process cartridges 20Y, 20M, 20C, and 20BK includes the photoconductor drum 21 as an image bearer, a charging device 22, and a cleaning device 23, which are united as a single unit as illustrated in FIG. 2. Each of the process cartridges 20Y, 20M, 20C, and 20BK, which is expendable, is replaced with a new one when depleted in a body of the image forming apparatus 1.

In each of the process cartridges 20Y, 20M, 20C, and 20BK, the developing device 26 is disposed to face the photoconductor drum 21. The developing device 26 is expendable and replaced with a new one when depleted in the body of the image forming apparatus 1. An operator can independently perform an installation and removal operation of the developing device 26 with respect to the body of the image forming apparatus 1 and an installation and removal operation of the process cartridges 20Y, 20M, 20C, and 20BK with respect to the body of the image forming apparatus 1 as different operations.

In the process cartridges 20Y, 20M, 20C, and 20BK, yellow, magenta, cyan, and black toner images are formed on the respective photoconductor drums 21 as the image bearers.

A description is provided of image forming processes of the image forming apparatus 1 to form a color toner image on a recording medium.

A conveyance roller of the document conveyance device 2 conveys a document on a document table onto a platen (exposure glass) of the scanner 3. The scanner 3 optically scans image data for the document on the platen.

The yellow, magenta, cyan, and black image data are transmitted to the exposure device 4. The exposure device 4 irradiates the photoconductor drums 21 (see FIG. 2) of the corresponding process cartridges 20Y, 20M, 20C, and 20BK with laser beams (as exposure light) L based on the yellow, magenta, cyan, and black image data, respectively.

Each of the four photoconductor drums 21 rotates clockwise in FIGS. 1 and 2. The surface of the photoconductor drum 21 is uniformly charged at a position where the photoconductor drum 21 faces the charging device 22 that is a charging roller, which is referred to as a charging process. Thus, the surface of the photoconductor drum 21 is charged to a certain potential. When the charged surface of the photoconductor drum 21 reaches a position to receive the laser beam L emitted from the exposure device 4, an electrostatic latent image based on the image data is formed on the surface of the photoconductor drum 21, which is referred to as an exposure process.

The laser beam L corresponding to the yellow image data is directed to the surface of photoconductor drum 21 in the process cartridge 20Y, which is the first from the left in FIG. 1 among the four process cartridges 20Y, 20M, 20C, and 20BK. A polygon mirror that rotates at high velocity deflects the laser beam L for yellow along the rotation axis direction of the photoconductor drum 21 (i.e., the main-scanning direction) so that the laser beam L scans the surface of the photoconductor drum 21. Thus, an electrostatic latent image for yellow is formed on the surface of the photoconductor drum 21 charged by the charging device 22.

Similarly, the laser beam L corresponding to the cyan image data is directed to the surface of the photoconductor drum 21 in the second process cartridge 20C from the left in FIG. 1, thus forming an electrostatic latent image for cyan on the surface of the photoconductor drum 21. The laser beam L corresponding to the magenta image data is directed to the surface of the photoconductor drum 21 in the third process cartridge 20M from the left in FIG. 1, thus forming an electrostatic latent image for magenta on the photoconductor drum 21. The laser beam L corresponding to the black image data is directed to the surface of the photoconductor drum 21 in the fourth process cartridge 20BK from the left in FIG. 1, thus forming an electrostatic latent image for black on the photoconductor drum 21.

Then, the surfaces of the photoconductor drums 21 having the respective electrostatic latent images reach positions opposed to the corresponding developing devices 26 (see FIG. 2). The developing device 26 deposits toner of each color onto the surface of the photoconductor drum 21 and develops the electrostatic latent image on the photoconductor drum 21 into a toner image, which is referred to as a development process.

After the development process, the surfaces of the photoconductor drums 21 reach positions facing the intermediate transfer belt 40. The primary transfer rollers 24 are disposed at the positions where the photoconductor drums 21 face the intermediate transfer belt 40 and in contact with an inner circumferential surface of the intermediate transfer belt 40, respectively. At the positions of the primary transfer rollers 24, the toner images on the photoconductor drums 21 are sequentially transferred to and superimposed on the intermediate transfer belt 40, forming a multicolor toner image thereon, which is referred to as a primary transfer process.

After the primary transfer process, the surface of the photoconductor drum 21 reaches a position opposite the cleaning device 23. The cleaning device 23 collects untransferred toner remaining on the photoconductor drum 21, which is referred to as a cleaning process.

Subsequently, a residual potential of the surface of the photoconductor drum 21 is removed at a position opposite the discharger, and a series of image forming processes performed on the photoconductor drum 21 is completed.

Meanwhile, the surface of the intermediate transfer belt 40, onto which the single-color toner images on the photoconductor drums 21 are superimposed, moves in the direction indicated by arrow in FIG. 1 and reaches a position opposite the secondary transfer roller 65. The secondary transfer roller 65 secondarily transfers the multicolor toner image on the intermediate transfer belt 40 to the sheet P, which is referred to as a secondary transfer process.

After the secondary transfer process, the surface of the intermediate transfer belt 40 reaches a position opposite a belt cleaning device. The belt cleaning device collects untransferred toner on the intermediate transfer belt 40 to complete a series of transfer processes on the intermediate transfer belt 40.

The sheet P is conveyed from the sheet feeder 61 to the position of the secondary transfer roller 65 via a registration roller pair 64.

Specifically, a sheet feed roller 62 feeds the sheet P from top of multiple sheets P accommodated in the sheet feeder 61, and the sheet P is conveyed to a registration roller pair 64 through a sheet feed path. The sheet P that has reached the registration roller pair 64 is conveyed toward the position of the secondary transfer roller 65, timed to coincide with the arrival of the multicolor toner image on the intermediate transfer belt 40.

Subsequently, the sheet P, onto which the multicolor image is transferred, is conveyed to the fixing device 66. The fixing device 66 includes a fixing roller and a pressure roller pressing against each other. In a nip between the fixing roller and the pressure roller, the multicolor image is fixed on the sheet P.

After the fixing process, an output roller pair 69 ejects the sheet P as an output image to the exterior of the image forming apparatus 1, and the ejected sheet P is stacked on an output tray 5 to complete a series of image forming processes.

Next, with reference to FIGS. 2 and 3, the image forming units of the image forming apparatus 1 are described in detail below.

The four image forming units in the body of the image forming apparatus 1 have a similar configuration except the color of the toner used in the image forming processes. Therefore, parts of the image forming unit such as the process cartridge and the developing device are illustrated without suffixes Y, M, C, and BK, which denote the color of the toner, in the drawings.

As illustrated in FIG. 2, the process cartridge 20 mainly includes the photoconductor drum 21 as the image bearer, the charging device 22, and the cleaning device 23, which are stored in a case of the process cartridge 20 as a single unit.

The photoconductor drum 21 is an organic photoconductor designed to be charged with a negative polarity and includes a photosensitive layer formed on a drum-shaped conductive support.

The charging device 22 is the charging roller including a conductive core and an elastic layer of moderate resistivity coated on the conductive core. A power supply applies a predetermined voltage to the charging device 22 that is the charging roller, and the charging device 22 uniformly charges the surface of the photoconductor drum 21 opposite the charging device 22.

The cleaning device 23 includes a cleaning blade 23*a* and a cleaning roller 23*b* that contact the photoconductor drum 21. For example, the cleaning blade 23*a* is made of rubber, such as urethane rubber, and contacts the surface of the photoconductor drum 21 at a predetermined angle with a predetermined pressure. The cleaning roller 23*b* is a brush roller in which brush bristles are provided around a core.

Figure 3:
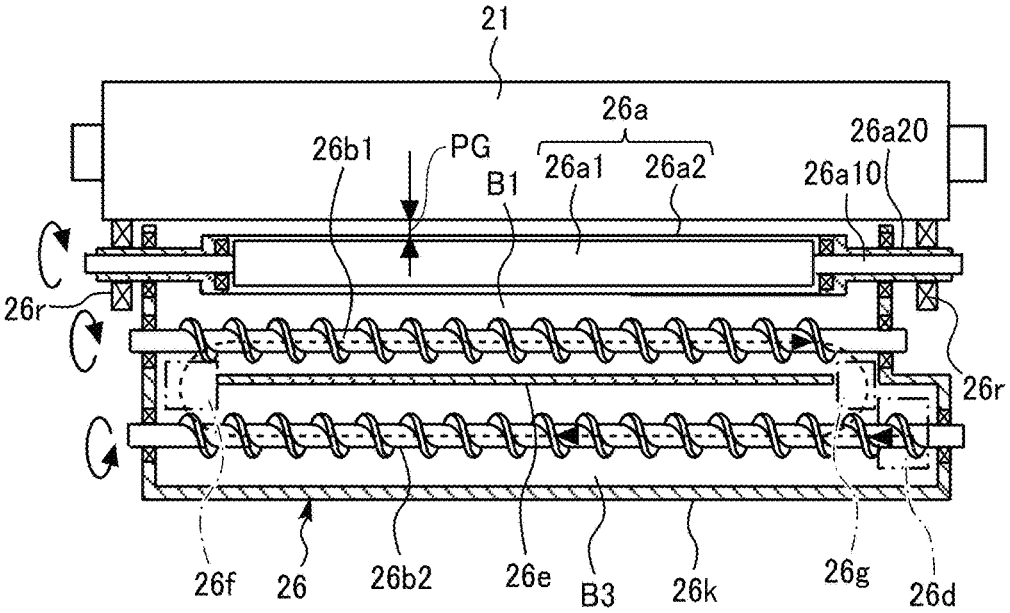
FIG. 3 is a schematic cross-sectional view of a developing device and a photoconductor drum of the image forming unit of FIG. 2 as viewed along a longitudinal direction of the developing device.

As illustrated in FIGS. 2 and 3, the developing device 26 mainly includes a developing roller 26*a* as a developer bearer, a first conveying screw 26*b*1 as a first conveyor facing the developing roller 26*a*, a partition 26*e*, a second conveying screw 26*b*2 as a second conveyor facing the first conveying screw 26*b*1 via the partition 26*e*, and a doctor blade 26*c* as a developer regulator facing the developing roller 26*a* to regulate an amount of developer borne on the developing roller 26*a*.

The developing device 26 stores a two-component developer including carrier and toner.

The developing roller 26*a* is opposed to the photoconductor drum 21 with a small gap, thereby forming a developing range. As illustrated in FIG. 3, the developing roller 26*a* includes stationary magnets 26*a*1 as magnetic field generators, which are fixed not to rotate, inside and a sleeve 26*a*2 that rotates around the magnets 26*a*1. The magnets 26*a*1 generate multiple poles (magnetic fields) around the outer circumferential surface of the developing roller 26*a*.

The doctor blade 26*c* is above the developing roller 26*a* and is opposed to the developing roller 26*a* with a small gap as a doctor-gap DG to suitably adjust the amount of the developer carried on the developing roller 26*a*.

The first conveying screw 26*b*1 and the second conveying screw 26*b*2 convey the developer stored in the developing device 26 in the longitudinal direction of the developing device 26, thereby establishing a circulation path indicated by the dashed arrow in FIG. 3. That is, the first conveying screw 26*b*1 establishes a first conveyance path B1, and the second conveying screw 26*b*2 establishes a second conveyance path B2. The circulation path of the developer includes the first conveyance path B1 and the second conveyance path B2.

The partition 26*e* is an inner wall and separates the first conveyance path B1 from the second conveyance path B2, and the first and second conveyance paths B1 and B2 communicate with each other via first and second communication openings 26*f* and 26*g* disposed at both ends of the first and second conveyance paths B1 and B2 in the longitudinal direction. Specifically, with reference to FIG. 3, in a conveyance direction of the developer, an upstream end of the first conveyance path B1 communicates with a downstream end of the second conveyance path B2 via the first communication opening 26*f*. Additionally, in the conveyance direction of the developer, a downstream end of the first conveyance path B1 communicates with an upstream end of the second conveyance path B2 via the second communication opening 26*g*. That is, the partition 26*e* is disposed along the circulation path in the longitudinal direction except both ends of the circulation path.

The first conveying screw 26*b*1 in the first conveyance path B1 is opposite the developing roller 26*a*, and the second conveying screw 26*b*2 in the second conveyance path B2 is opposite the first conveying screw 26*b*1 in the first conveyance path B1 via the partition 26*e*. The first conveying screw 26*b*1 supplies developer to the developing roller 26*a* and collects the developer that separates from the developing roller 26*a* after the development process while conveying the developer in the longitudinal direction of the developing device 26 (that is the lateral direction in FIG. 3 and an axial direction of the first conveying screw). The second conveying screw 26*b*2 stirs and mixes the developer after the development process conveyed from the first conveyance path B1 with a fresh toner supplied from a replenishing port 26*d* while conveying the developer in the longitudinal direction of the developing device 26.

In the present embodiment, the first and second conveying screws 26*b*1 and 26*b*2 are horizontally arranged in parallel. Each of the first and second conveying screws 26*b*1 and 26*b*2 includes a shaft and a screw blade wound around the shaft.

A further detailed description is given of the image forming processes described above, focusing on the development process.

The developing roller 26*a* as the developer bearer rotates clockwise in a direction indicated by arrow in FIG. 2. As illustrated in FIGS. 2 and 3, the first conveying screw 26*b*1 and the second conveying screw 26*b*2 are disposed facing each other with the partition 26*e* interposed therebetween and rotate in directions indicated by arrows in FIGS. 2 and 3. Toner is supplied from the toner container 70 to the replenishing port 26*d* via a toner supply path. As the first conveying screw 26*b*1 and the second conveying screw 26*b*2 rotate in the respective directions in FIG. 2, the developer stored in the developing device 26 circulates in the longitudinal direction of the developing device 26, that is, the direction indicated by the dashed arrow in FIG. 3, and the supplied toner is stirred and mixed with the developer circulating.

Stirring the developer causes the toner to be charged by friction with carrier in the developer and electrostatically attracted to the carrier. A magnetic force is generated on the developing roller 26*a* to scoop up the carrier. The magnetic force that is called as a developer scooping pole scoop up the carrier with the toner on the developing roller 26*a*. The developer borne on the developing roller 26*a* is conveyed in the counterclockwise direction indicated by arrow in FIG. 2 to a position opposite the doctor blade 26*c*. The doctor blade 26*c* adjusts an amount of the developer on the developing roller 26*a* at the position. Subsequently, rotation of the sleeve 26*a*2 conveys the developer to a developing range in which the developing roller 26*a* faces the photoconductor drum 21. The electric field formed in the developing range deposits toner on the electrostatic latent image formed on the photoconductor drum 21. As the sleeve 26*a*2 rotates, the developer remaining on the developing roller 26*a* reaches above the first conveyance path B1 and separates from the developing roller 23*a*. In the developing range, a predetermined voltage as a developing bias is applied to the developing roller 26*a* by a development power supply, and a surface potential as a latent image potential is formed on the photoconductor drum 21 in the charging process and the exposure process. The developing bias and the latent image potential form an electric field in the developing range.

In the present embodiment, the developing roller 26*a* and the photoconductor drum 21 do not move in the same direction in the developing range. The developing roller 26*a* moves in the opposite direction (counter direction) of the movement direction of the photoconductor drum 21 in the developing range. This configuration can satisfactorily develop the latent image on the photoconductor drum 21 even if the linear velocity difference between the photoconductor drum 21 and the developing roller 26*a* in the developing range is small.

The toner in the toner container 70 is supplied through the replenishing port 26*d* to the developing device 26 as the toner in the developing device 26 is consumed. The toner consumption in the developing device 26 is detected by a toner concentration sensor that magnetically detects a toner concentration in the developer (i.e., a ratio of toner to the developer) in the developing device 26.

The replenishing port 26*d* is disposed above an end of the second conveying screw 26*b*2 in the second conveyance path B2 in the longitudinal direction that is the left and right direction in FIG. 3.

The configuration and operation of the developing device 26 according to the present embodiment are described in further detail below.

As described above with reference to FIGS. 2 and 3, the developing device 26 includes a developing roller 26*a* as the developer bearer facing the photoconductor drum 21 and develops the latent image formed on the surface of the photoconductor drum 21 as the image bearer.

The developing roller 26*a* includes a sleeve 26*a*2 that is rotatable and magnets 26*a*1 as the magnetic field generator that is irrotationally fixed inside the sleeve 26*a*2. The sleeve 26*a*2 is a cylindrical member and has hollow shafts 26*a*20 at both ends in an axial direction of the sleeve 26*a*2 that is the lateral direction in FIG. 3. The magnets 26*a*1 is a columnar member and has non-rotating shafts 26*a*10 at both ends in an axial direction of the magnets 26*a*1 that is the lateral direction in FIG. 3.

A developing case 26*k* is a housing to store the developer inside, rotatably supports the developing roller 26*a*, the first conveying screw 26*b*1, and the second conveying screw 26*b*2, and holds the doctor blade 26*c*.

In particular, in the present embodiment, the developing case 26*k* rotatably supports the hollow shafts 26*a*20 formed at the axial ends of the sleeve 26*a*2 via ball bearings.

Figure 4:
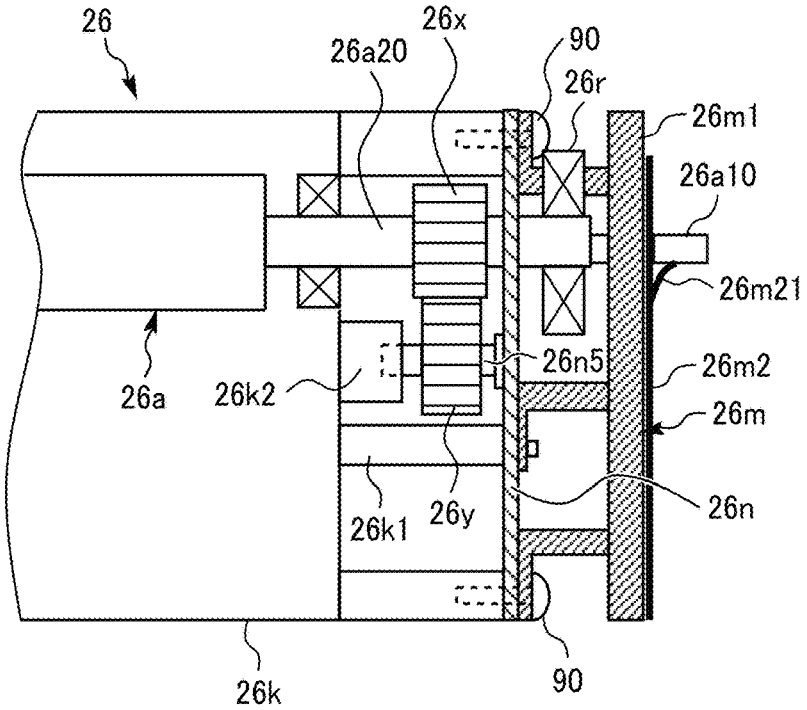
FIG. 4 is a schematic enlarged view of an end portion of the developing device of FIG. 3 in an axial direction of a developing roller.

In addition, as illustrated in FIGS. 3 and 4, bearings 26*r* as gap forming members are disposed on the hollow shafts 26*a*20 of the sleeve 26*a*2 to contact the photoconductor drum 21. The bearings 26*r* set a gap between the photoconductor drum 21 and the developing roller 26*a* that is a development gap PG illustrated in FIG. 2.

Specifically, the bearings 26*r* are disposed at the hollow shafts 26*a*20 at both ends of the developing roller 26*a* and contact non-image formation areas of the surface of the photoconductor drum 21. The outer circumferential surfaces of the bearings 26*r* are made of low friction material. Abutting the bearings 26*r* against the surface of the photoconductor drum 21 determines a distance between the center axis of the developing roller 26*a* and the surface of the photoconductor drum 21 to set the development gap to a target value.

Accurately setting the development gap PG to the target value optimizes the electric field formed in the developing range, which enables suitably performing the development process.

Preferably, a biasing member is disposed to bias the developing device 26 toward the photoconductor drum 21 so that the bearings 26*r* reliably contact the photoconductor drum 21.

The developing case 26*k* holds the doctor blade 26*c* so as to be able to adjust the doctor gap DG that is a gap between the developing roller 26*a* and the doctor blade 26*c* (see FIG. 2).

When the doctor gap DG is accurately set to a target value, the doctor blade 26*c* optimizes an amount of the developer borne on the developing roller 26*a* that is supplied to the developing range in the development process, which enables suitably performing the development process.

Figure 5:
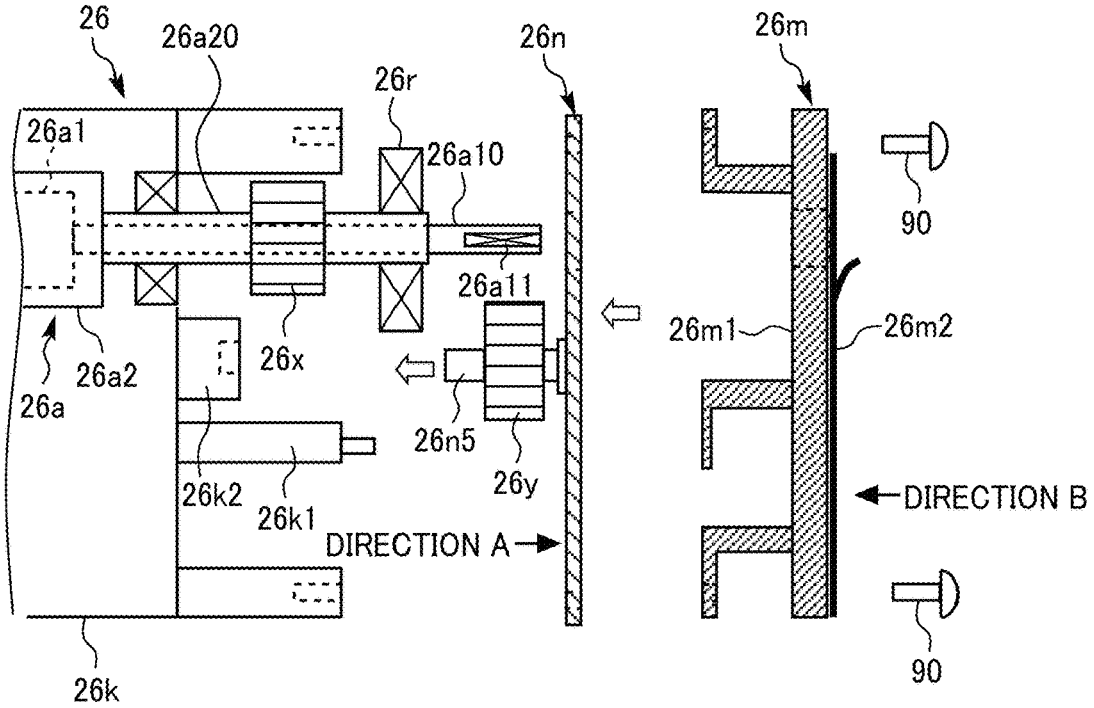
FIG. 5 is a schematic enlarged view of the end portion of the developing device, a support, and a gear holder when the support and the gear holder are removed from the developing device of FIG. 4.
Figure 6:
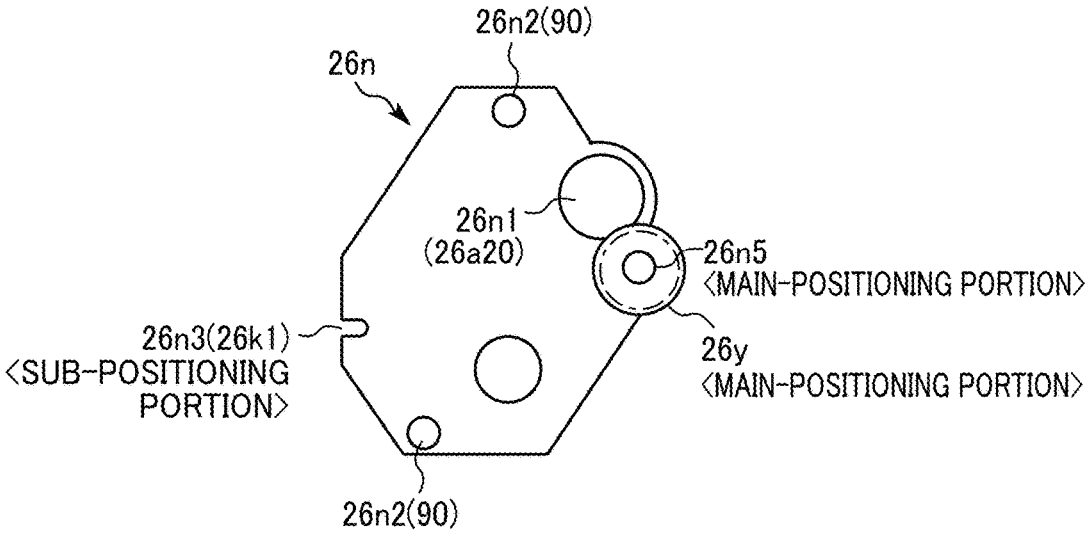
FIG. 6 is a schematic view of the gear holder of FIG. 5 viewed from a direction A in FIG. 5.
Figure 7A:
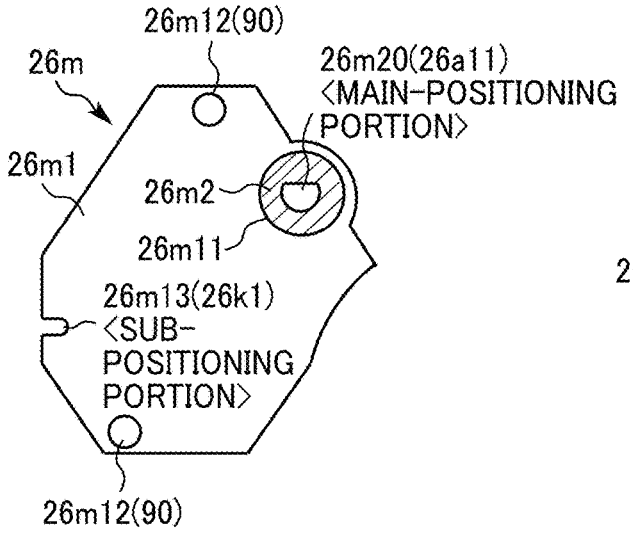
FIG. 7A is a schematic view of the support of FIG. 5 viewed from the direction A in FIG. 5.
Figure 7B:
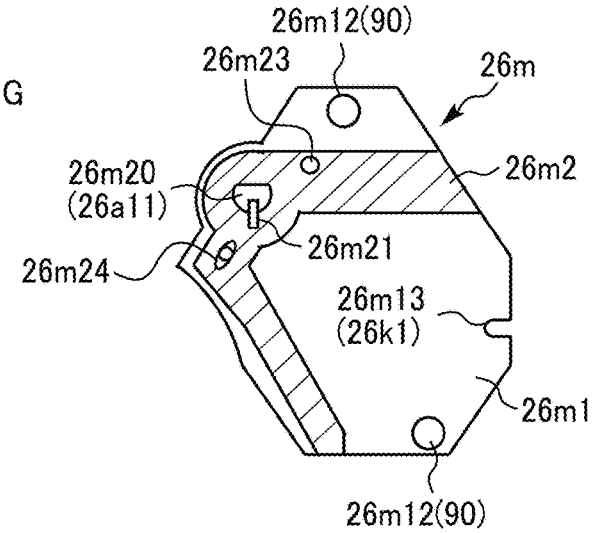
FIG. 7B is a schematic view of the support of FIG. 5 viewed from a direction B in FIG. 5.

As illustrated in FIGS. 4 to 7B, the developing device 26 according to the present embodiment includes supports 26*m* and gear holders 26*n* at both ends in the axial direction of the sleeve 26*a*2 that is the lateral direction in FIGS. 3 to 5 and a direction perpendicular to a plane on which FIGS. 6 and 7 are illustrated.

In addition, the developing device 26 includes the non-rotating shafts 26*a*10 at both ends of the magnets 26*a*1 as the magnetic field generator disposed inside the developing roller 26*a*. The non-rotating shaft 26*a*10 penetrates through the hollow shaft 26*a*20 of the sleeve 26*a*2 and projects outward, that is, right side in FIG. 4. As illustrated in FIG. 5, the non-rotating shaft 26*a*10 has a D-cut portion 26*a*11 on a part of the non-rotating shaft 26a10 that is a predetermined area extending from the axial end toward the center. The D-cut portion 26a11 is made by a milling process so as to form a planar portion on the non-rotating shaft 26a10, that is, so that a cross section of the D-cut portion 26a11 orthogonal to the axial direction has a D-shape.

The support 26m has a D-shaped hole 26m20 (see FIGS. 7A and 7B) as a fitting portion into which the non-rotating shaft 26a10 of the magnets 26a1 as the magnetic field generator is fitted so as not to rotate.

The support 26m is supported by the developing case 26k, and the D-shaped hole 26m20 (the fitting portion) becomes a main-positioning portion.

Specifically, the support 26m includes a base plate 26m1 as a main support and an electrode 26m2 as a conductor fixed on the base plate 26m1. The base plate 26m1 is made of a non-conductive material such as resin. The electrode 26m2 is a plate made of a conductive material such as metal to apply a developing bias to the developing roller 26a via the non-rotating shaft 26a10.

As illustrated in FIGS. 7A and 7B, the base plate 26m1 as the main support has a hole 26m11 having a hole diameter larger than a shaft diameter of the non-rotating shaft 26a10. The non-rotating shaft 26a10 passes through the hole 26m11 without contacting the base plate 26m1.

In addition, the base plate 26m1 has a notch 26m13. The developing case 26k includes a boss 26k1 (see FIGS. 4 and 5) including a small diameter portion formed at the tip of the boss 26k1. The small diameter portion is fitted into the notch 26m13. The notch 26m13 serves as a sub-positioning portion when the support 26m is disposed and positioned on the developing case 26k.

Additionally, the base plate 26m1 has two holes 26m12 to fix the support 26m with screws 90 (that is, screw fastening). The support 26m is positioned on the developing case 26k by using the D-shaped hole 26m20 serving as the main positioning portion and the notch 26m13 serving as the sub-positioning portion. The hole diameter of the holes 26m12 is sufficiently larger than the outer diameter of the external threads of the screw 90.

On the other hand, as illustrated in FIGS. 7A and 7B, the electrode 26m2 as the conductor has a D-shaped hole 26m20 as a fitting portion into which the D-cut portion 26a11 of the non-rotating shaft 26a10 is fitted. The D-shaped hole 26m20 serves as the main-positioning portion when the support 26m is fixed on the developing case 26k as described above. As illustrated in FIG. 7A, the D-shaped hole 26m20 of the electrode 26m2 is exposed from the hole 26m11 of the base plate 26m1 when viewed from the inside of the developing device 26, that is, viewed from the direction A in FIG. 5.

In addition, as illustrated in FIG. 7B, the electrode 26m2 has a thermal caulking hole 26m23 serving as the main-positioning portion and a thermal caulking slot 26m24 serving as the sub-positioning portion. Bosses formed on the base plate 26m1 pass through the thermal caulking hole 26m23 and thermal caulking slot 26m24 and are thermally melted, respectively, which is thermal caulking processing, to fix the electrode 26m2 on the base plate 26m1.

The electrode 26m2 comes in contact with or separates from a terminal disposed in the body to the image forming apparatus 1 in conjunction with the attachment/detachment operation of the developing device 26 with respect to the main body of the image forming apparatus 1. When the electrode 26m2 comes in contact with the terminal, a power supply in the body of the image forming apparatus 1 supplies a predetermined developing bias to the developing roller 26a via the terminal, the electrode 26m2, and the non-rotating shaft 26a10.

The electrode 26m2 has a cut-and-bent portion 26m21 (see FIGS. 4 and 7B) in the vicinity of the D-shaped hole 26m20 in order to ensure contact with the non-rotating shaft 26a10. The cut-and-bent portion 26m21 prevents failure in applying the developing bias from the electrode 26m2 to the non-rotating shaft 26a10.

Referring to FIGS. 4 to 6, the gear holder 26n includes a support shaft 26n5 and an idler gear 26y rotatably held by the support shaft 26n5. The idler gear 26y meshes with a drive gear 26x disposed on the hollow shaft 26a20 and rotating together with the sleeve 26a2. In the present embodiment, the gear holder 26n is a bracket made of metal.

The drive gear 26x disposed on the developing roller 26a (specifically, the hollow shaft 26a20 of the sleeve 26a2) meshes with or separates from a motor gear of a drive motor disposed in the body to the image forming apparatus 1 in conjunction with the attachment/detachment operation of the developing device 26 with respect to the main body of the image forming apparatus 1. The drive motor drives the drive gear 26x to drive and rotate the developing roller 26a, and the driving force of the drive motor is transmitted to the gear train including the idler gear 26y to drive the first conveying screw 26b1 and second conveying screw 26b2.

The developing case 26k supports the gear holder 26n together with the support 26m.

Specifically, the support shaft 26n5 of the gear holder 26n is fitted into a depression formed in the tip of the boss 26k2 disposed on the developing case 26k (see FIGS. 4 and 5). The support shaft 26n5 serves as the main-positioning portion when the gear holder 26n is disposed and positioned on the developing case 26k.

In addition, as illustrated in FIG. 6, the gear holder 26n has a notch 26n3. The small diameter portion formed at the tip of the boss 26k1 (see FIGS. 4 and 5) on the developing case 26k is fitted into the notch 26n3. The notch 26n3 serves as the sub-positioning portion when the gear holder 26n is disposed and positioned on the developing case 26k.

Additionally, the gear holder 26n has two holes 26n2 to fix the gear holder 26n on the developing case 26k with screws 90 (that is, screw fastening). The gear holder 26n is positioned on the developing case 26k by using the support shaft 26n5 serving as the main positioning portion and the notch 26n3 serving as the sub-positioning portion. The hole diameter of the holes 26n2 is sufficiently larger than the outer diameter of the external threads of the screw 90. The screws 90 to fix the gear holder 26n on the developing case 26k are used together with the screw fastening to fix the support 26m on the developing case 26k. In other words, the gear holder 26n is sandwiched between the support 26m and the developing case 26k, and the gear holder 26n and the support 26m are screwed together on the developing case 26k. (The gear holder 26n and the support 26m are assembled from the state illustrated in FIG. 5 to the state as illustrated in FIG. 4.)

As described above, the developing device 26 according to the present embodiment has a configuration in which the non-rotating shaft 26a10 of the magnets 26a1 is fitted into the D-shaped hole 26m20 serving as the main-positioning portion to support the support 26m on the developing case 26k.

The above-described configuration can more accurately and stably position the developing roller 26a than a configuration in which another part serves as the main-positioning portion to support the support 26*m* on the developing case 26*k*.

Figure 8A:
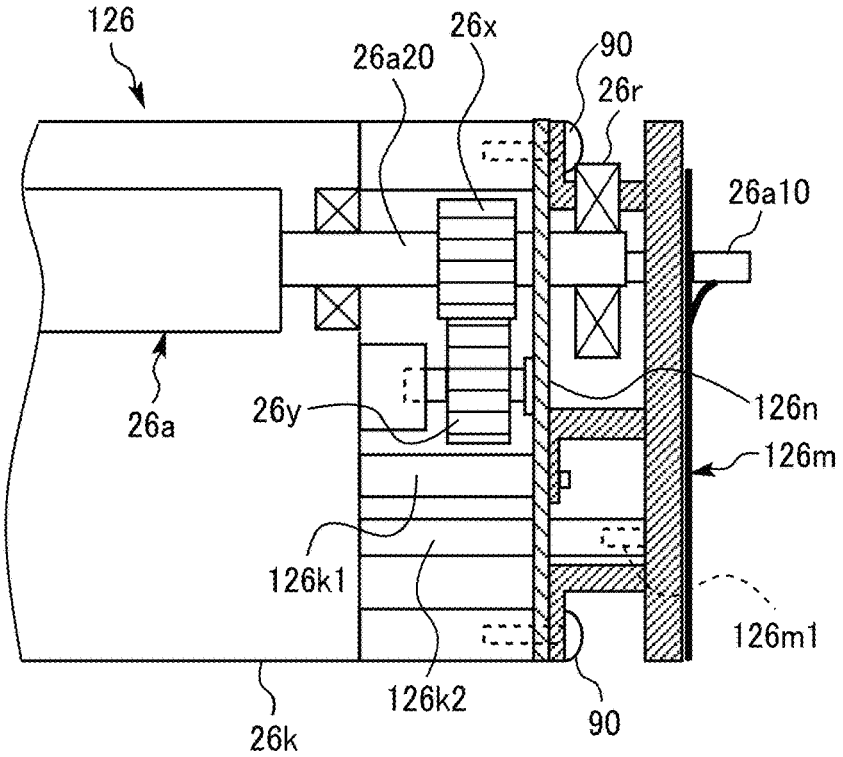
FIG. 8A is a schematic enlarged view of an end portion of the developing device according to a comparative embodiment in the axial direction of a developing roller.
Figure 8B:
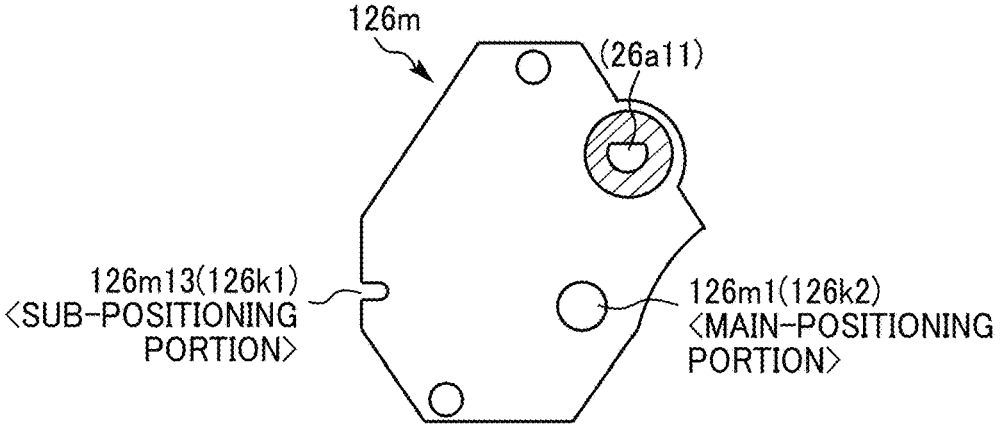
FIG. 8B is a schematic view of a support of the developing device according to the comparative embodiment of FIG. 8A.

With reference to FIGS. 8A and 8B, a developing device 126 according to a comparative embodiment is described below. The developing device 126 includes a support 126*m* including a boss 126*m*1 as the main-positioning portion at a position away from the developing roller 26*a*. The developing device 126 includes a boss 126*k*2 disposed on the developing case 26*k* and having a recess at the top of the boss 126*k*2. The boss 126*m*1 as the main-positioning portion is fitted into the recess to support the support 126*m* on the developing case 26*k*. In the above-described configuration, accumulated tolerance of dimensions of parts and errors during assembling are likely to shift the position of the developing roller 26*a* from a target position.

The hollow shaft 26*a*20 of the developing roller 26*a* is supported on the developing case 26*k* through a ball bearing, but the non-rotating shaft 26*a*10 of the developing roller 26*a* is supported by the support 126*m*. Accordingly, the non-rotating shaft 26*a*10 displaced from a target position with respect to the developing case 26*k* generates force that bends the developing roller 26*a* in a direction perpendicular to the axial direction of the developing roller 26*a*. Driving force transmission from the drive gear 26*x* disposed on the hollow shaft 26*a*20 to the idler gear 26*y* disposed on the gear holder 126*n* generates a reaction force acting on the drive gear 26*x* so as to bend the developing roller 26*a* in the direction perpendicular to the axial direction.

Accordingly, positions of the developing rollers 26*a* (that is, the non-rotating shafts 26*a*10) vary in the developing devices 126 according to the comparative embodiment (or each time the support 126*m* is attached to the developing case 26*k*) and frequently shift from the target position. Variation in the positions of the developing rollers 26*a* causes variation in developing gaps PG between developing rollers 26*a* and the photoconductor drums 21 and variation in doctor gaps DG between developing rollers 26*a* and the doctor blades 26*c*, which causes formation of an image having a large image density difference.

In contrast, the developing device 26 according to the present embodiment has the configuration in which the non-rotating shaft 26*a*10 of the developing roller 26*a* is fitted into the D-shaped hole 26*m*20 serving as the main-positioning portion to fix the support 26*m* on the developing case 26*k*. This configuration easily positions the non-rotating shaft 26*a*10 to the target position with respect to the developing case 26*k*. As a result, the above-described configuration is not likely to cause the disadvantage that accumulated tolerance of dimensions of parts and errors during assembling shift the position of the developing roller 26*a* (that is, the non-rotating shaft 26*a*10) from a target position and causes bending of the developing roller 26*a* in the direction perpendicular to the axial direction. In the above-described configuration, the developing roller 26*a* is not easily bent even when the driving force transmission from the drive gear 26*x* disposed on the hollow shaft 26*a*20 to the idler gear 26*y* disposed on the gear holder 126*n* generates the reaction force acting on the drive gear 26*x*.

Accordingly, positions of the developing rollers 26*a* (that is, the non-rotating shafts 26*a*10) do not vary in the developing devices 26 according to the present embodiment (or each time the support 26*m* is attached to the developing case 26*k*), and the developing roller 26*a* (that is, the non-rotating shaft 26*a*10) is accurately and stably positioned to the target position. As a result, the developing gap PG between the developing roller 26*a* and the photoconductor drum 21 and the doctor gap DG between the developing roller 26*a* and the doctor blade 26*c* are not likely to vary, and the image having the target image density and a stable image density difference is formed.

In particular, the developing roller 26*a* and the photoconductor drum 21 in the present embodiment do not move in the same direction in the developing range. The developing roller 26*a* moves in the opposite direction (counter direction) of the movement direction of the photoconductor drum 21 in the developing range. In this configuration, the variation in the developing gap PG and the variation in the doctor gap DG are likely to cause an image density variation. Accordingly, the present disclosure is helpful.

Note that FIGS. 4 to 13B illustrate one end portion of the developing device 26 in the axial direction, but the other end portion of the developing device 26 in the axial direction may have the same configuration. Similar to the one end portion of the developing device 26 in the axial direction, the other end portion of the developing device 26 may include the support 26*m* and the gear holder 26*n*.

The present inventors performed experiments to confirm variations in the developing gaps PG, the doctor gaps DG, and the image density differences when the support 26*m* was attached to developing case 26*k* to complete the developing device 26 according to the present embodiment in several times, and the support 126*m* was attached to developing case 26*k* to complete the developing device 126 illustrated as the comparative embodiment in FIGS. 8A and 8B in several times.

As a result, unacceptable variations in the developing gaps PG, the doctor gaps DG, and the image density differences occurred in the developing devices 126 according to the comparative embodiment. In contrast, all variations in the developing gaps PG, the doctor gaps DG, and the image density differences in the developing devices 26 according to the present embodiment were acceptable levels.

The above-described experimental results confirmed the effect of the above-described embodiment.

Next, a first variation is described.

Figure 9A:
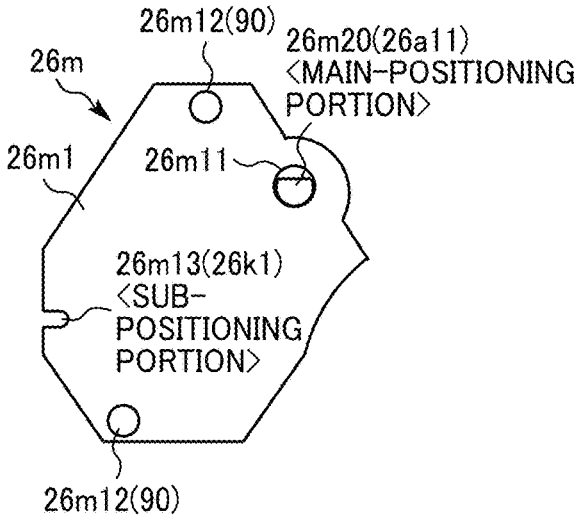
FIG. 9A is a schematic view of the support according to a first variation viewed from the direction A of FIG. 5.
Figure 9B:
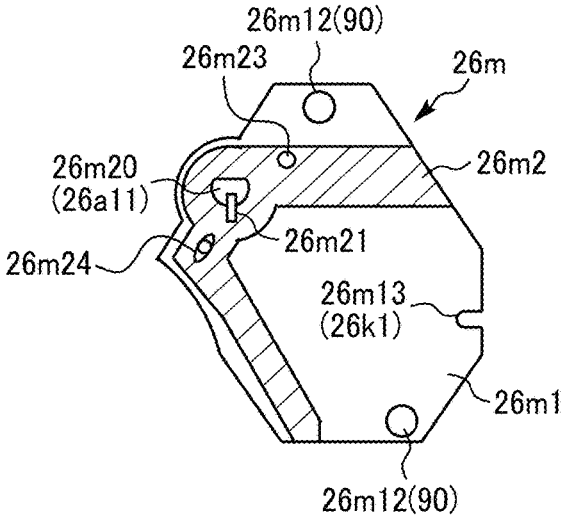
FIG. 9B is a schematic view of the support according to the first variation viewed from the direction B of FIG. 5.

As illustrated in FIGS. 9A and 9B, the support 26*m* in a first variation includes the base plate 26*m*1 as the main support having a hole 26*m*11 different from the hole illustrated in FIG. 7A. The hole 26*m*11 has a substantially same hole diameter as the shaft diameter of the non-rotating shaft 26*a*10. The non-rotating shaft 26*a*10 penetrates the hole 26*m*11 and contacts the base plate 26*m*1.

In addition, similar to the electrode as illustrated in FIGS. 7A and 7B, the electrode 26*m*2 as the conductor of the support 26*m* has the D-shaped hole 26*m*20 as the fitting portion into which the D-cut portion 26*a*11 of the non-rotating shaft 26*a*10 is fitted.

In the support 26*m* configured as described above, the hole 26*m*11 of the base plate 26*m*1 positions the non-rotating shaft 26*a*10 in addition to the D-shaped hole 26*m*20 of the electrode 26*m*2, which is different from the support illustrated in FIGS. 7A and 7B. Accordingly, the above-described configuration can more accurately and stably position the developing roller 26*a* than the configuration as illustrated in FIGS. 7A and 7B.

The present inventors performed experiments to confirm variations in the developing gaps PG, the doctor gaps DG, and the image density differences when the support 26*m* was attached to developing case 26*k* to complete the developing device 26 according to the first variation and the present embodiment including the support 26*m* as illustrated in FIGS. 7A and 7B in several times. As a result, all variations in the developing gaps PG, the doctor gaps DG, and the image density differences in the developing devices 26 according to the first variation were smaller than those in the developing device 26 including the support 26*m* as illustrated in FIGS. 7A and 7B.

In the first variation, the main-positioning portion of the electrode 26*m*2 with respect to the base plate 26*m*1 illustrated in FIG. 9B, that is, the boss inserted into the thermal caulking hole 26*m*23 may be removed. Removing the boss enables easily sliding the electrode 26*m*2 on the base plate 26*m*1 so that the non-rotating shaft 26*a*10 penetrates the electrode 26*m*2 and the base plate 26*m*1 even when the position of the shaft penetrating the hole 26*m*11 of the base plate 26*m*1 is relatively shifted from the position of the shaft penetrating the D-shaped hole 26*m*20. In addition, designing a center line of the thermal caulking slot 26*m*24 serving as the sub-positioning portion of the electrode 26*m*2 so as to pass through the center of the D-shaped hole 26*m*20 can improve a positional accuracy of the D-cut portion 26*a*11 with respect to the non-rotating shaft 26*a*10.

Next, a second variation is described.

Figure 10A:
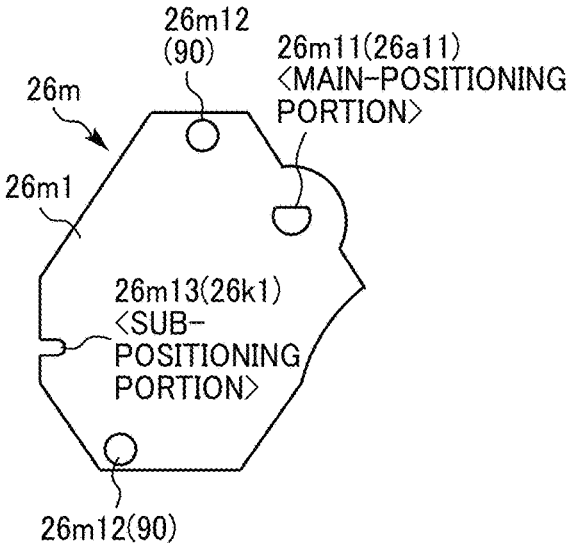
FIG. 10A is a schematic view of the support according to a second variation viewed from the direction A of FIG. 5.
Figure 10B:
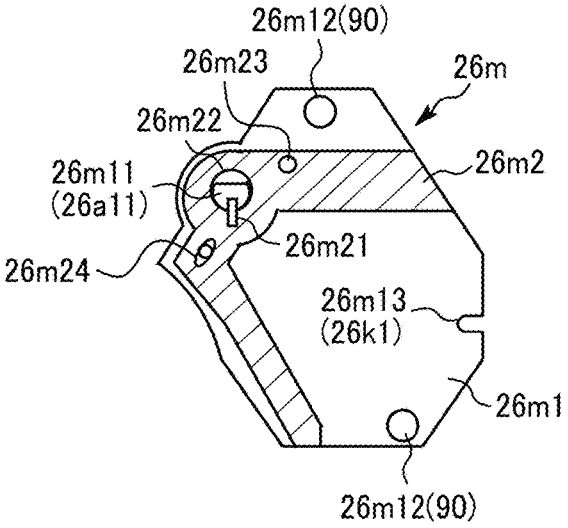
FIG. 10B is a schematic view of the support according to the second variation viewed from the direction B of FIG. 5.

As illustrated in FIGS. 10A and 10B, the support 26*m* in a second variation includes the base plate 26*m*1 as the main support having a D-shaped hole 26*m*11 different from the holes illustrated in FIGS. 7A and 9A, and the D-cut portion 26*a*11 of the non-rotating shaft 26*a*10 is fitted into the D-shaped hole 26*m*11 as the fitting portion.

In addition, the electrode 26*m*2 as the conductor of the support 26*m* has a circular hole 26*m*22 having a hole diameter substantially equal to or larger than the shaft diameter of the non-rotating shaft 26*a*10, which is different from the electrodes illustrated in FIGS. 7B and 9B.

In the support 26*m* configured as described above, the hole 26*m*11 of the base plate 26*m*1 positions the non-rotating shaft 26*a*10 without rotation. As a result, the developing roller 26*a* is accurately and stably positioned.

A third variation is described.

Figure 11A:
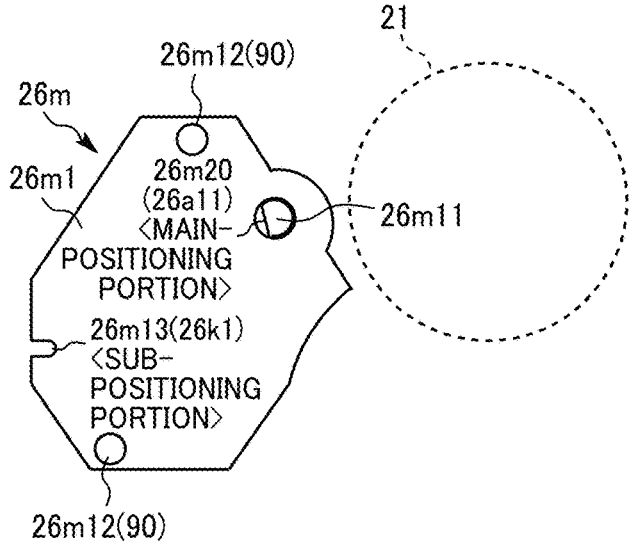
FIGS. 11A and 11B are schematic views of the support according to a third variation.

As illustrated in FIG. 11A, the D-cut portion 26*a*11 formed on the non-rotating shaft 26*a*10 of the developing roller 26*a* (that is, the magnets 26*a*1) in the developing device 26 according to the third variation faces the photoconductor drum 21 in a cross section perpendicular to the axial direction of the non-rotating shaft 26*a*10.

Specifically, in the cross section perpendicular to the axial direction, a flat portion of the fitting portion (that is the D-shaped hole 26*m*20 formed on the electrode 26*m*2 in FIG. 11A) of the support 26*m* into which the D-cut portion 26*a*11 is fitted, that is, the flat portion facing the flat portion of the D-cut portion 26*a*11 is orthogonal to an imaginary line passing through the center axis of the photoconductor drum 21 and the center axis of the developing roller 26*a*. In addition, the flat portion is disposed farther than the center axis of the developing roller 26*a* from the photoconductor drum 21.

Figure 11B:
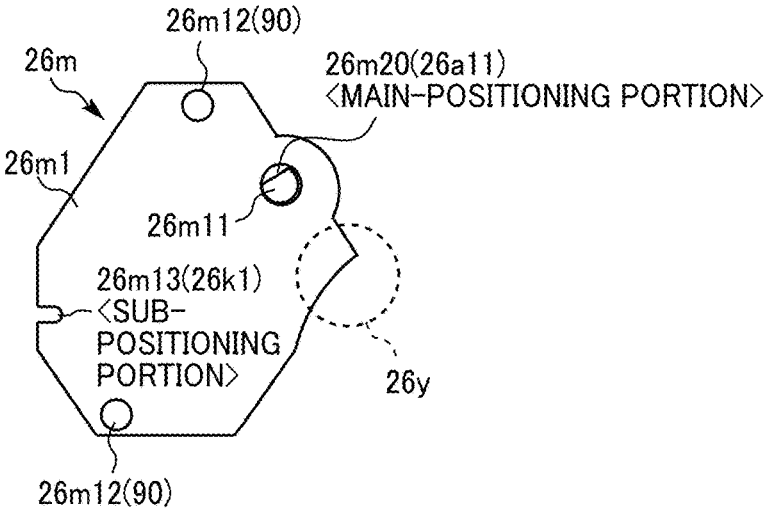

Alternatively, as illustrated in FIG. 11B, the D-cut portion 26*a*11 formed on the non-rotating shaft 26*a*10 of the developing roller 26*a* (that is, the magnets 26*a*1) in the developing device 26 according to another embodiment of the third variation faces the idler gear 26*y* disposed on the gear holder 26*n* in a cross section perpendicular to the axial direction of the non-rotating shaft 26*a*10.

Specifically, in the cross section perpendicular to the axial direction, a flat portion of the fitting portion (that is the D-shaped hole 26*m*20 formed on the electrode 26*m*2 in FIG. 11B) of the support 26*m* into which the D-cut portion 26*a*11 is fitted, that is, the flat portion facing the flat portion of the D-cut portion 26*a*11 is orthogonal to an imaginary line passing through the center axis of the idler gear 26*y* (that is, the support shaft 26*n*5) and the center axis of the developing roller 26*a*. In addition, the flat portion is disposed farther than the center axis of the developing roller 26*a* from the idler gear 26*y*.

The configurations illustrated in FIGS. 11A and 11B enable easily setting the posture of the magnets 26*a*1 fixed not to rotate in the developing device 26 (that is, the angle of the magnets 26*a*1) in the rotation direction of the developing roller 26*a* with respect to the photoconductor drum 21 or the doctor blade 26*c*. Specifically, as the developing device 26 is driven, the developing roller 26*a* receives a pressure from the photoconductor drum 21 via the developer and receives a reaction force from the idler gear 26*y*. The pressure and the reaction force at this time are forces pushing the D-cut portion 26*a*11 of the non-rotating shaft 26*a*10 to the flat portion of the D-shaped hole 26*m*20 of the electrode 26*m*2. Accordingly, the flat portion of the D-shaped hole 26*m*20 of the electrode 26*m*2 accurately determines the posture (that is, the angle) of the non-rotating shaft 26*a*10 in the rotation direction of the developing roller 26*a*.

Figure 12:
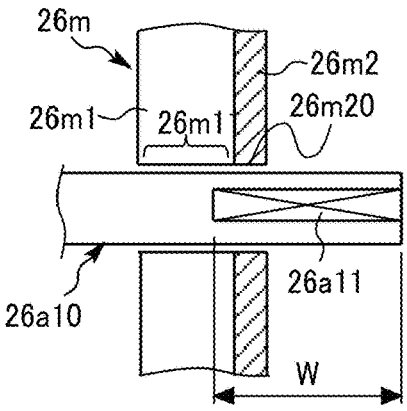
FIG. 12 is an enlarged view of the support and a D-cut portion of a non-rotating shaft, illustrating a positional relationship of the support and the D-cut portion in the axial direction of the shaft.

With reference to FIG. 12, a configuration regarding the D-cut portion 26*a*11 of the non-rotating shaft 26*a*10 in the third variation (or the second variation and the fourth variation described below) is described. Preferably, the D-cut portion 26*a*11 of the non-rotating shaft 26*a*10 is formed a range W in the axial direction from the middle of the hole 26*m*11 of the base plate 26*m*1 as the main support to a tip of the non-rotating shaft 26*a*10 via the D-shaped hole 26*m*20 as the fitting portion of the electrode 26*m*2 as the conductor.

In the above-described configuration, at least a part of a hole of the base plate 26*m*1 into which the non-rotating shaft 26*a*10 is fitted is a cylindrical hole. In other words, at least a part of the hole 26*m*11 of the base plate 26*m*1 into which the D-cut portion 26*a*11 is fitted is the cylindrical hole. In addition, the D-cut portion 26*a*11 is fitted into the electrode 26*m*2 at a position at which the D-cut portion 26*a*11 on the non-rotating shaft 26*a*10 starts to extend.

A cylindrical portion of the non-rotating shaft 26*a*10 has a higher dimensional accuracy than the D-cut portion 26*a*11. Since the above-described configuration receives the cylindrical portion of the non-rotating shaft 26*a*10 on the base plate 26*a*1, the above-described configuration can accurately set the developing gap PG. Since the D-cut portion 26*a*11 is formed by performing secondary processing (milling processing) on the cylindrical portion of the non-rotating shaft 26*a*10, in general, the D-cut portion 26*a*11 has a larger tolerance than the cylindrical portion, and the dimensional accuracy of the D-cut portion 26*a*11 is inferior to that of the cylindrical portion.

If the D-cut portion 26*a*11 of the non-rotating shaft 26*a*10 penetrates an entire portion of the hole 26*m*11 of the base plate 26*m*1 in the axial direction, in other words, if the D-cut portion 26*a*11 of the non-rotating shaft 26*a*10 penetrates the hole 26*m*11 that is a cylindrical hole extending in the base plate 26*m*1 in the axial direction and is supported by the base plate 26*m*1, in addition to the tolerance of the non-rotating shaft 26*a*10 and the tolerance of the hole 26*m*11, a clearance generated by the D-cut portion 26*a*11 increases the variation of the developing gap PG that is affected by pressures applied from the photoconductor drum 21 and the idler gear 26*y*. Disposing the D-cut portion 26*a*11 of the non-rotating shaft 26*a*10 in the part of the hole 26*m*11 in the axial direction as illustrated in FIG. 12 can improve the disadvantage described above.

In the third variation, a plurality of magnetic poles generated by the magnets 26*a*1 are positioned to target positions in the rotational direction of the developing roller 26*a* with respect to a D-cut surface (that is a flat surface) of the D-cut portion 26*a*11 as a reference. The D-cut surface (that is the flat surface) of the D-cut portion 26*a*11 is suitable for the reference because the D-cut surface is easily visible not only in the state of the developing roller 26*a* alone but also in the state of being installed in the developing device 26 to confirm the positional relationship between the D-cut surface and the photoconductor drum 21 or the idler gear 26*y*.

As a result, the above configurations reduce the variation of the postures of the magnets 26*a*1 (that is, the angles of the magnets 26*a*1) in the rotation direction of the developing roller 26*a* with respect to the photoconductor drum 21 or the doctor blade 26*c* and enable forming images having stable and good image qualities.

A fourth variation is described.

Figure 13A:
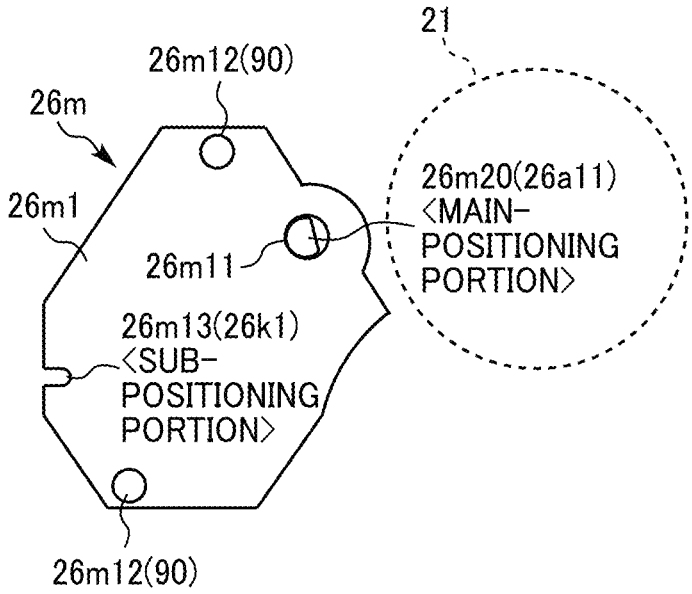
FIGS. 13A and 13B are schematic views of the support according to a fourth variation.

As illustrated in FIG. 13A, the D-cut portion 26*a*11 formed on the non-rotating shaft 26*a*10 of the developing roller 26*a* (that is, the magnets 26*a*1) in the developing device 26 according to the fourth variation also faces the photoconductor drum 21 in the cross section perpendicular to the axial direction of the non-rotating shaft 26*a*10. However, the D-cut portion 26*a*11 is disposed at a position rotated from the D-cut portion illustrated in FIG. 11A by approximately 180 degrees about the center axis of the non-rotating shaft 26*a*10.

Specifically, in the cross section perpendicular to the axial direction, a flat portion of the fitting portion (that is the D-shaped hole 26*m*20 formed on the electrode 26*m*2 in FIG. 13A) of the support 26*m* into which the D-cut portion 26*a*11 is fitted, that is, the flat portion facing the flat portion of the D-cut portion 26*a*11 is orthogonal to an imaginary line passing through the center axis of the photoconductor drum 21 and the center axis of the developing roller 26*a*. In addition, the flat portion is disposed nearer to the photoconductor drum 21 than the center axis of the developing roller 26*a*.

Figure 13B:
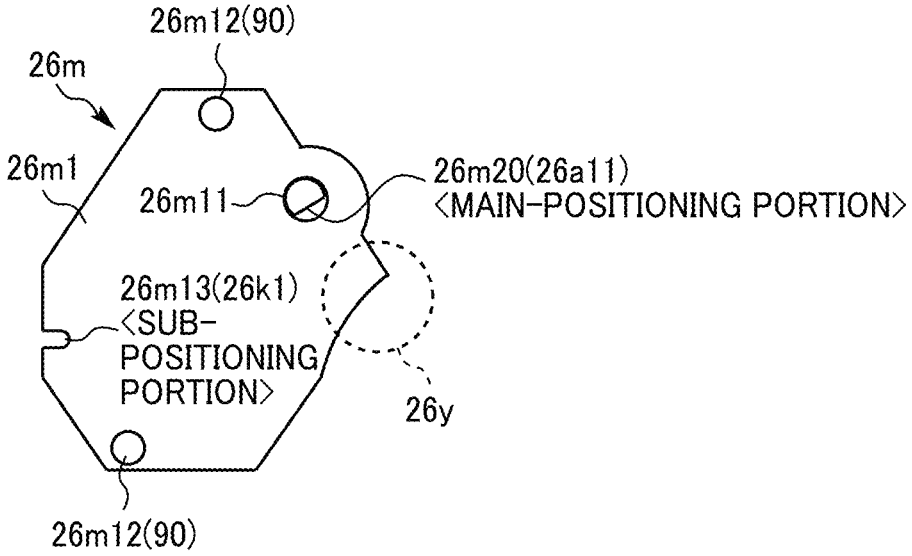

Alternatively, as illustrated in FIG. 13B, the D-cut portion 26*a*11 formed on the non-rotating shaft 26*a*10 of the developing roller 26*a* (that is, the magnets 26*a*1) in the developing device 26 according to another embodiment of the fourth variation also faces the idler gear 26*y* disposed on the gear holder 26*n* in a cross section perpendicular to the axial direction of the non-rotating shaft 26*a*10. However, the D-cut portion 26*a*11 is disposed at a position rotated from the D-cut portion illustrated in FIG. 11B by approximately 180 degrees about the center axis of the non-rotating shaft 26*a*10.

Specifically, in the cross section perpendicular to the axial direction, a flat portion of the fitting portion (that is the D-shaped hole 26*m*20 formed on the electrode 26*m*2 in FIG. 13B) of the support 26*m* into which the D-cut portion 26*a*11 is fitted, that is, the flat portion facing the flat portion of the D-cut portion 26*a*11 is orthogonal to an imaginary line passing through the center axis of the idler gear 26*y* (that is, the support shaft 26*n*5) and the center axis of the developing roller 26*a*. In addition, the flat portion is disposed nearer to the idler gear 26*y* than the center axis of the developing roller 26*a*.

The configurations illustrated in FIGS. 13A and 13B enable easily setting the posture of the magnets 26*a*1 fixed not to rotate in the developing device 26 (that is, the angle of the magnets 26*a*1) in the rotation direction of the developing roller 26*a* with respect to the photoconductor drum 21 or the doctor blade 26*c*. Specifically, the plurality of magnetic poles generated by the magnets 26*a*1 are positioned to the target positions in the rotational direction of the developing roller 26*a* with respect to the D-cut surface (that is the flat surface) of the D-cut portion 26*a*11 as the reference. The D-cut surface (that is the flat surface) of the D-cut portion 26*a*11 is suitable for the reference because the D-cut surface is easily visible not only in the state of the developing roller 26*a* alone but also in the state of being installed in the developing device 26 to confirm the positional relationship between the D-cut surface and the photoconductor drum 21 or the idler gear 26*y*.

As a result, the above configurations reduce the variation of the postures of the magnets 26*a*1 (that is, the angles of the magnets 26*a*1) in the rotation direction of the developing roller 26*a* with respect to the photoconductor drum 21 or the doctor blade 26*c* and enable forming images having stable and good image qualities.

As described above, the developing device 26 includes the developing roller 26*a*. The developing roller 26*a* includes the rotatable sleeve 26*a*2 and the magnets 26*a*1 as the magnetic field generator irrotationally disposed in the sleeve 26*a*2. In addition, the developing device 26 includes the developing case 26*k* to store the developer inside and rotatably support the hollow shaft 26*a*20 formed at the axial ends of the sleeve 26*a*2. In addition, the non-rotating shafts 26*a*10 are attached to both ends of the magnets 26*a*1. The non-rotating shaft 26*a*10 penetrates through the hollow shaft 26*a*20 and projects outward. The developing device 26 includes the support 26*m* having the hole 26*m*20 (the fitting portion). The non-rotating shaft 26*a*10 of the magnets 26*a*1 is fitted into the hole 26*m*20. The support 26*m* is supported on the developing case 26*k* using the hole 26*m*20 as the main-positioning portion.

As a result, the developing roller 26*a* is accurately and stably positioned.

In the present embodiment, the process cartridge 20 does not include the developing device 26, and the developing device 26 is a unit that can be independently installed in and removed from the body of the image forming apparatus 1. In contrast, the developing device 26 may be one of the constituent members of the process cartridge 20, and the process cartridge 20 may be configured to be integrally installed in and removed from the body of the image forming apparatus 1.

In such a configuration, similar effects to those of the above-described embodiment and variations are also attained.

It is to be noted that the term "process cartridge" used in the present disclosure means a removable unit including an image bearer and at least one of a charging device to charge the image bearer, a developing device to develop latent images on the image bearer, and a cleaning device to clean the image bearer that are united together and is designed to be removably installed as a united part in the body of the image forming apparatus.

In the present embodiment according to the present disclosure, the developing device 26 includes two conveying screws 26*b*1 and 26*b*2 as the conveyors horizontally arranged in parallel and the doctor blade 26*c* disposed above the developing roller 26*a*. The configuration of the developing device to which the present disclosure is applied is not limited to the above-described configurations. The present disclosure may be applied to other developing devices such as a developing device including two conveyers obliquely arranged, a developing device including two conveyers arranged in parallel in the vertical direction, a developing device including three or more conveyors arranged, a developing device including the doctor blade disposed below the developing roller, or a developing device in which the developing roller rotates in the same direction as the photoconductor drum rotates in the developing range.

Applying the present disclosure to the above developing devices can provide effects similar to the effects of the above-described embodiments and variations.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

What is claimed is:

1. A developing device, comprising:

a developing roller including:

a sleeve that is rotatable, the sleeve including a hollow shaft at an axial end of the sleeve; and a magnetic field generator that is irrotationally disposed inside the sleeve, the magnetic field generator including a non-rotating shaft at an axial end of the magnetic field generator, and the non-rotating shaft penetrating through the hollow shaft and projecting outward;

a developing case to store developer and rotatably support the hollow shaft; and a support including a fitting portion into which the non-rotating shaft of the magnetic field generator is irrotationally fitted, the support being supported on the developing case using the fitting portion as a main-positioning portion, wherein the support further includes, a main support of a non-conductive material, and a conductor of a conductive material, the conductor is fixed on the main support, and the conductor to apply a developing bias to the developing roller via the non-rotating shaft.

2. The developing device according to claim 1, further comprising:

a drive gear disposed on the hollow shaft, the drive gear to rotate together with the sleeve;

a gear meshing the drive gear; and a gear holder supported on the developing case together with the support, the gear holder to rotatably hold the gear.

3. The developing device according to claim 1, wherein a part of the non-rotating shaft includes a flat surface portion which extends parallel to an axis of the non-rotating shaft, the main support has a hole having a hole diameter larger than a shaft diameter of the non-rotating shaft and being penetrated by the non-rotating shaft that does not contact the main support, and the conductor has the fitting portion into which the flat surface portion of the non-rotating shaft is fitted.

4. The developing device according to claim 3, wherein the flat surface portion is disposed at a position rotated from a position at which the flat surface portion faces a photoconductor drum to be faced by the developing roller by 180 degrees about a center axis of the non-rotating shaft in a cross section of the flat surface portion orthogonal to an axial direction of the non-rotating shaft.

5. The developing device according to claim 3, further comprising:

a drive gear disposed on the hollow shaft, the drive gear to rotate together with the sleeve; and a gear meshing the drive gear, wherein the flat surface portion is disposed at a position rotated from a position at which the flat surface portion faces the gear by 180 degrees about a center axis of the non-rotating shaft in a cross section of the flat surface portion orthogonal to an axial direction of the non-rotating shaft.

6. The developing device according to claim 3, wherein the flat surface portion faces a photoconductor drum to be faced by the developing roller in a cross section of the flat surface portion orthogonal to an axial direction of the non-rotating shaft.

7. The developing device according to claim 3, further comprising:

a drive gear disposed on the hollow shaft, the drive gear to rotate together with the sleeve; and a gear meshing the drive gear, wherein the flat surface portion faces the gear that in a cross section of the flat surface portion orthogonal to an axial direction of the non-rotating shaft.

8. The developing device according to claim 3, wherein a part of the non-rotating shaft is a D-cut portion including the flat surface portion.

9. The developing device according to claim 1, wherein a part of the non-rotating shaft includes a flat surface portion, the main support has a hole having a hole diameter substantially equal to a shaft diameter of the non-rotating shaft and being penetrated by the non-rotating shaft that contacts the main support, and the conductor has the fitting portion into which the flat surface portion of the non-rotating shaft is fitted.

10. The developing device according to claim 9, wherein the flat surface portion is in a range on the non-rotating shaft from a middle of the hole of the main support to a tip of the non-rotating shaft via the fitting portion of the conductor.

11. The developing device according to claim 1, wherein a part of the non-rotating shaft is a flat surface portion, and the main support has the fitting portion into which the flat surface portion of the non-rotating shaft is fitted.

12. The developing device according to claim 11, wherein the fitting portion includes a hole of the main support.

13. The developing device according to claim 12, wherein a part of the non-rotating shaft is a D-cut portion including the flat surface portion, and the fitting portion includes a D-shaped hole into which the D-cut portion of the shaft is fitted.

14. The developing device according to claim 1, further comprising:

a bearing disposed on the hollow shaft, the bearing to contact a photoconductor drum to define a gap between the photoconductor drum and the developing roller.

15. An image forming apparatus, comprising:

the developing device according to claim 1.

16. A developing device, comprising:

a developing roller including:

a sleeve that is rotatable, the sleeve including a hollow shaft at an axial end of the sleeve; and a magnetic field generator that is irrotationally disposed inside the sleeve, the magnetic field generator including a non-rotating shaft at an axial end of the magnetic field generator, and the non-rotating shaft penetrating through the hollow shaft and projecting outward; and a support including a fitting portion into which the non-rotating shaft of the magnetic field generator is irrotationally fitted, wherein the support further includes a main support of a non-conductive material, and a conductor of a conductive material, the conductor is fixed on the main support, and the conductor to apply a developing bias to the developing roller via the non-rotating shaft, a part of the non-rotating shaft includes a flat surface portion which extends parallel to an axis of the non-rotating shaft, the main support has a hole having a hole diameter larger than a shaft diameter of the non-rotating shaft and being penetrated by the non-rotating shaft that does not contact the main support, and the conductor has the fitting portion into which the flat surface portion of the non-rotating shaft is fitted.

17. A developing device, comprising:

a developing roller including:

a sleeve that is rotatable, the sleeve including a hollow shaft at an axial end of the sleeve; and a magnetic field generator that is irrotationally disposed inside the sleeve, the magnetic field generator including a non-rotating shaft at an axial end of the magnetic field generator, and the non-rotating shaft penetrating through the hollow shaft and projecting outward; and a support including a fitting portion into which the non-rotating shaft of the magnetic field generator is irrotationally fitted, wherein the support further includes a main support of a non-conductive material, and a conductor of a conductive material, the conductor is fixed on the main support, and the conductor to apply a developing bias to the developing roller via the non-rotating shaft, a part of the non-rotating shaft includes a flat surface portion, the main support has a hole having a hole diameter substantially equal to a shaft diameter of the non-rotating shaft and being penetrated by the non-rotating shaft that contacts the main support, the conductor has the fitting portion into which the flat surface portion of the non-rotating shaft is fitted, and the flat surface portion is in a range on the non-rotating shaft from a middle of the hole of the main support to a tip of the non-rotating shaft via the fitting portion of the conductor.

* * * * *